United States Patent [19]

Reynolds

[11] Patent Number: 4,778,589

[45] Date of Patent: Oct. 18, 1988

[54] DECALCIFICATION OF HYDROCARBONACEOUS FEEDSTOCKS USING CITRIC ACID AND SALTS THEREOF

[75] Inventor: John G. Reynolds, El Cerrito, Calif.

[73] Assignee: Chevron Research Company, San Francisco, Calif.

[21] Appl. No.: 901,341

[22] Filed: Aug. 28, 1986

[51] Int. Cl.[4] ..... C10G 17/00

[52] U.S. Cl. ..... 208/252; 208/251 R; 208/309; 423/155; 423/165

[58] Field of Search ..... 208/252, 251 R, 309; 423/155, 165; 585/866

[56] References Cited

U.S. PATENT DOCUMENTS

| | | | |
|---|---|---|---|
| 2,767,123 | 10/1956 | Hickok | 196/42 |
| 2,976,233 | 3/1961 | Selkin | 208/251 R |
| 3,052,627 | 9/1962 | Lerner | 208/251 R |
| 3,153,623 | 10/1964 | Eldib et al. | 208/251 R |
| 3,167,500 | 1/1965 | Payne | 208/251 R |
| 3,317,421 | 5/1967 | Gleim et al. | 208/251 H |
| 3,322,664 | 5/1967 | Paterson et al. | 208/48 |
| 4,280,897 | 7/1981 | Shah et al. | 208/113 |
| 4,431,524 | 2/1984 | Norman | 208/252 |
| 4,432,864 | 2/1984 | Norman | 208/252 |
| 4,439,345 | 3/1984 | Duke | 252/330 |
| 4,539,099 | 9/1985 | Merchant et al. | 208/251 R |
| 4,568,450 | 2/1986 | Tiny et al. | 208/251 H |

FOREIGN PATENT DOCUMENTS

| | | | |
|---|---|---|---|
| 642497 | 6/1962 | Canada | 208/252 |

*Primary Examiner*—Asok Pal
*Assistant Examiner*—Helane Myers
*Attorney, Agent, or Firm*—S. R. La Paglia; T. G. DeJonghe; Q. T. Dickinson

[57] ABSTRACT

A process is disclosed for the removal of metals contaminants, particularly calcium, from hydrocarbonaceous feedstocks. The process comprises mixing the feedstock with an aqueous solution of a metals sequestering agent, particularly hydroxocarboxylic acids, especially citric acid, then salts or mixtures thereof, and separating the aqueous solution containing the metals from the demetalated feedstock.

13 Claims, 1 Drawing Sheet

CALCIUM REMOVAL BY CITRIC ACID, EQUIVALENCE DEPENDENCE

San Joaquin Valley Crude (53 ppm Ca)
10% Aqueous Volume, Room Temperature
30 Seconds Mixing Time

DECALCIFICATION OF HYDROCARBONACEOUS FEEDSTOCKS USING CITRIC ACID AND SALTS THEREOF

BACKGROUND OF THE INVENTION

This invention relates to a process for the removal of calcium from calcium-containing petroleum crudes, heavy hydrocarbonaceous residua or solvent deasphalted oils derived from crude and residua, using hydroxocarboxylic acids, particularly citric acid, as sequestering or chelating agents. A few, but increasingly important, petroleum crude feedstocks and residua contain levels of calcium which render them difficult, if not impossible, to process using conventional refining techniques. Specifically, the calcium contaminant causing particular problems is in the form of non-porphyrin, organometallically-bound compounds. These species have been only recently discovered in crude oils, very heavy crude oils in particular, and are apparenty relatively rare. One class of these calcium-containing compounds identified, in particular, is the calcium naphthenates and their homologous series. These organo-calcium compounds are not separated from the feedstock by normal desalting processes, and in a conventional refining technique they can cause the very rapid deactivation of hydroprocessing catalysts. Examples of feedstocks demonstrating objectionably high levels of calcium compounds are those from the San Joaquin Valley in California. Generally, these crudes are contained in a pipeline mixture referred to an San Joaquin Valley crude or residuum.

The problems presented by calcium in petroleum feedstocks and their necessity for removal have only been recently appreciated, and the prior art contains few references specifically to its removal. Metals removal generally using organic compounds, however, has been addressed in the prior art, specifically for the removal of known metallic contaminants, such as nickel, vanadium, and/or copper. These compounds are also ordinarily found in feedstocks as porphyrins, and other organometallic compounds.

In U.S. Pat. No. 3,052,627, Lerner, metals-contaminants are removed from crude petroleum feedstocks using a 2-pyrrolidone-alcohol mixture. In U.S. Pat. No. 3,167,500, Payne, metallic contaminants, such as metal-containing porphyrins, are removed from petroleum oils using a condensed polynuclear aromatic compound having a preferred C/H ratio and a molecular weight, ordinarily called pitch binders. In U.S. Pat. No. 3,153,623, Eldib et al., selected commercially available organic compounds of high dielectric strength were added to assist in the electrically directed precipitation removing metals with the polar organic molecules.

It has now been unexpectedly found that the calcium-containing contaminants may be effectively removed from hydrocarbonaceous feedstocks by binding the calcium compounds using citric acid and its salts.

SUMMARY OF THE INVENTION

The process comprises of a method for demetalating hydrocarbonaceous feedstocks, particularly crude petroleum or residua using an aqueous solution of a chelating agent. The method is particularly appropriate for removing calcium, especially non-porphyrin, organically-bound calcium compounds. The preferred metals chelating agents are the hydroxocarboxylic acids, such as citric and tartaric, their salts or mixtures thereof in an aqueous solution.

In a preferred process, the feedstock to be demetalized is intimately and thoroughly mixed with an aqueous solution of citric acid, or its salts or mixtures thereof. The metals combine with the agent to form a water-soluble complex in the aqueous phase. The aqueous phase and the hydrocarbon phase are separated, and the hydrocarbonaceous feedstock is then available for hydroprocessing.

DETAILED DESCRIPTION OF THE INVENTION

Figure 1:
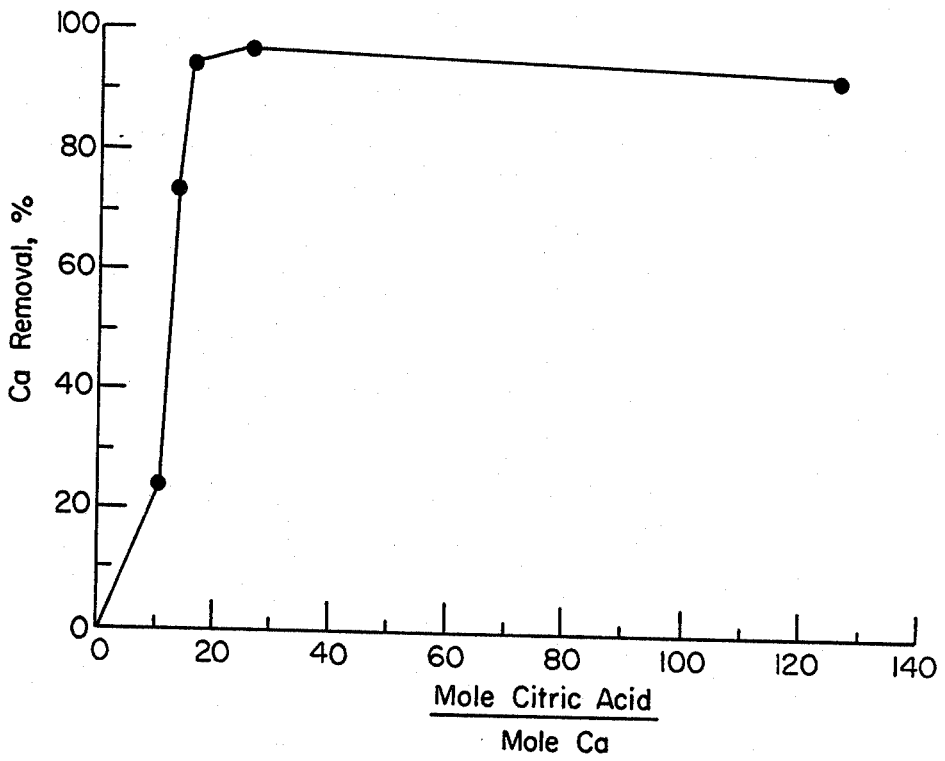

Various petroleum crude feedstocks and residua produced from them contain unacceptably high levels of calcium-containing contaminants. These organically-bound calcium compounds, cause distinct processing difficulties in standard hydroprocessing techniques, ordinarily by the rapid deactivation or fouling of the hydroprocessing catalyst. This invention comprises a method for removing those calcium-containing contaminants prior to hydroprocessing of the crude or residua by using a known chelating agents, or sequestering hydroxocarboxylic acid, particularly citric acid, or salts thereof.

The invention can be applied to any hydrocarbonaceous feedstock containing an unacceptably high level of calcium. Those feedstocks can include crude petroleum, especially from particular sources, such as San Joaquin Valley crude from California, more particularly including South Belridge, Kern Front, Cymric Heavy, Midway Sunset, or mixtures thereof. Additionally, atmospheric or vacuum residua or solvent deasphalted oils derived from these crudes and residua which are being increasingly hydroprocessed into more usable products, such as gas oils, gasoline, diesel fuel, etc., also have unacceptably high calcium levels. It is within the contemplation of the invention that any other hydrocarbonaceous feedstocks, such as shale oil, liquefied coal, beneficiated tar sand, etc., which may contain calcium contaminants, may be processed using this invention.

The basic process is relatively simple: The crude or residuum desired to be processed is mixed with an aqueous solution of citric acid, salts thereof or mixtures thereof, and a base for adjusting the pH above 2, and preferably between 5 to 9. The calcium is readily bound or chelated to the acid anion. This calcium/citric complex is ionic and is therefore soluble in the aqueous phase of the mixture. The two phases, the aqueous and the crude or hydrocarbonaceous phase, are separated or permitted to separate, and the aqueous solution is removed. The aqueous solution containing the calcium contaminant is removed, resulting in a calcium-free hydrocarbon feed. This feed can then be handled in the same manner as any other carbonaceous feed and processed by conventional hydroprocessing techniques. It is contemplated that the physical separation process is ordinarily to be done in a conventional crude oil desalter, which is usually used for desalting petroleum crudes prior to hydroprocessing. The separation may be done by any separation process, however, and may include countercurrent extraction.

It is well known that hydroxo carboxylic acids have a high affinity for calcium and other metal ions. Known as chelating agents, a common example of these hydroxo carboxylic acids is: citric acid—$C_6H_8O_7$; molecular weight 192.12. It is also known as 2-hydroxy-1,2,3-propanetricarboxylic acid, or beta-hydroxytricarballylic acid.

Citric acid is a member of a broad class of multidentate chelating ligands which complex or coordinate metal ions. These compounds form very stable metal ligand complexes. Currently, citric acid is used as a sequestering agent to remove trace metals, and it is also commonly used in the food and beverage industry as an acidulation agent and preservative.

Citric acid forms a complex with Ca+2 ion, which are stable and isolatable. Citric acid and its salts will complex other metal ions in aqueous solution but appears to have little or no effect on the more commonly found, ordinary organometallic metal contaminants in petroleum, suh a nickel and vanadium petroporphyrins. It may, however, have some effect on iron, and may be effective for removing organo-iron compounds.

The salt forms of citric acid can be generally formed in situ by the addition of most any strong base, and can be isolated in some cases, from the aqueous solution, as crystalline salts. The salts are generally more water soluble, and less acidic than the free acid.

As discussed previously, in order for the calcium to bind appropriately to the citric acid, the pH should be above 2, and preferably 5 to 9. One difficulty with the addition of base, however, is the formation of emulsions, which can interfere with effective separation. Therefore, the most preferred pH is 6, especially for naphthenic acid crudes.

The ratio of aqueous citric acid solution to hydrocarbonaceous feed should be optimized, with the determining factor being the separation method. Commercial desalters, for example, ordinarily run at 10% or less aqueous volume. Countercurrent extraction may also be used for separation. Effective separations have been done at 50% or more aqueous volume.

The contact time between the aqueous extraction solution and the hydrocarbonaceous feed is important, and may vary from between a few seconds to about 4 hours. The preferred contact time is from about 4 to about 60 seconds.

The temperature at which the extraction takes place is also a factor in process efficiency. The extraction may take place at room temperature, but the mole equivalents of citric acid will be limited to 10 or above. If the extraction takes place at elevated temperatures, for example, 180° F. and above, the mole equivalents may be reduced to 1 or above. A preferred temperature is about 300° F. and above.

EXAMPLES

In laboratory trials—the results of which are detailed in the tables below—the amount of San Joaquin Valley vacuum residuum (93 ppm Ca) or crude was dissolved in toluene to give a workable viscosity, and was mixed with the indicated amount of citric acid solution. The solution was prepared by dissolving the appropriate amount of citric acid in deionized $H_2O$ to give the specific mole citric acid to mole calcium ratio, and the pH was adjusted to approximately 9 with ammonium hydroxide. A demulsifier, tradenamed treatolite L-1562, was added in those instances where indicated. The citric acid/oil mixture was shaken and allowed to separate, preferably overnight at room temperature. The residuum was analyzed before and after processing to determine the amount of calcium removed.

EXAMPLE 1

To demonstrate citric acid as an effective calcium removal agent, comparative tests were performed on both the crude and vacuum residuum of San Joaquin Valley. Table I indicates that almost all the calcium was removed by relatively low amounts of citric acid mole equivalents. In the comparative extractions performed with refinery desalter water, acids, and bases, the percent of calcium removal was low.

EXAMPLE 2

Laboratory trials were performed at room temperature to optimize the amount of citric acid used in extraction of the calcium. FIG. 1 shows the activity of the citric acid begins to decrease around 22 mole equivalents, and drastically decreases around 12.5 equivalents.

EXAMPLE 3

To increase the activity of the citric acid, the extraction temperature was increased to 180° F. and the contact time was raised to 5 minutes or longer. Table II indicates that at this temperature, the activity of the citric acid was greatly enhanced, and the mole equivalents can be reduced down to 1 per mole of calcium.

EXAMPLE 4

To demonstrate the dependency on pH of the citric acid solution for most effective calcium removal, extractions were performed at the natural pH of citric acid, and at pH 6. Table III indicates citric acid is much more effective for calcium removal at the higher pH.

TABLE I

| San Joaquin Valley Feed | Extraction Agent | Aqueous Volume | Equivalents | pH | Ca Removal, % |
|---|---|---|---|---|---|
| crude | citric acid | 50% | 25 | 6 | 97 |
| VR | citric acid | 51% | 22 | 6 | 99 |
| crude | desalter water | 51% | — | 6 | 19 |
| VR | acid water | 66% | — | 2 | 7 |
| VR | $NH_4OH$ | 75% | — | 9 | 9 |

Room Temperature

TABLE II

| ID | EQ. | pH | t | Temp. | % Ca Rem. |
|---|---|---|---|---|---|
| B7654-37 | 5 | 6.0 | 10 min. | 180° F. | 99 |
| B7654-36 | 12.5 | 6.0 | 5 min. | 180° F. | 93 |
| B7654-39 | 1.25 | 6.0 | 10 min. | 180° F. | 97 |

TABLE III

Ca Removal with Citric Acid at Different pH, SJV VR

| Mole Equivalents | pH | % Ca Removal |
|---|---|---|
| 2.2 | 1.1 | 37 |
| 22 | 1.8 | 30 |
| 156 | 1.5 | 99 |
| 22 | 6.1 | 99 |
| 222 | 6.1 | 99 |

What is claimed is:

1. An aqueous extraction method for demetalizing Group IIA metals from hydrocarbonaceous feedstock, said method comprising:

mixing said hydrocarbonaceous feedstock with an aqueous solution of a metals sequestering agent, wherein said metals sequestering agent comprises hydroxo-carboxylic acids, salts or mixtures thereof; and separating the substantially demetalated hydrocarbonaceous feedstock from the aqueous solution; wherein the feedstock to be demetalated is selected from the group consisting of crude petroleum, atmospheric or vacuum residua, solvent deasphalted oil derived from these crudes or residua, shale oil, liquified coal, and tar sand effluent.

2. The method as claimed in claim 1 wherein the metal is calcium.

3. The method as claimed in claim 1 wherein the metals are organometallically-bound, non-porphyrin compounds.

4. The method as claimed in claim 3 wherein the compounds are compounds of calcium.

5. The method as claimed in claim 1 wherein the said metals sequestering agent comprises of citric acid, salts, or mixtures thereof.

6. The method as claimed in claim 1 or 5 wherein the pH of the mixing step is adjusted to 2 or above.

7. The method as claimed in claim 1 or 5 wherein the pH of the mixing step is adjusted to 5 or above.

8. The method as claimed in claim 7 wherein the temperature is ambient.

9. The method as claimed in claim 8 wherein the mole equivalents of citric acid to Ca is 10 or above.

10. The method as claimed in claim 7 wherein the temperature is about 180° F. and above.

11. The method as claimed in claim 7 wherein the temperature is about 300° F.

12. The method as claimed in claim 11 wherein the mole equivalents of citric acid to Ca is 1 or above.

13. The method as claimed in claim 1 where said separating is performed by conventional desalting processes or countercurrent extraction.

* * * * *